United States Patent [19]

Noel et al.

[11] 4,203,621

[45] May 20, 1980

[54] LOCK IN PARTICULAR FOR AN AUTOMOBILE VEHICLE

[75] Inventors: Jean P. Noel; Marcel Party, both of Saint-Die, France

[73] Assignee: Compagnie Industrielle de Mecanismes, France

[21] Appl. No.: 938,498

[22] Filed: Aug. 31, 1978

[30] Foreign Application Priority Data

Sep. 12, 1977 [FR] France ..... 77 27497
Jul. 18, 1978 [FR] France ..... 78 21260

[51] Int. Cl.[2] ..... E05C 3/26
[52] U.S. Cl. ..... 292/216
[58] Field of Search ..... 292/336, 216, DIG. 24, 292/DIG. 25, DIG. 26

[56] References Cited

U.S. PATENT DOCUMENTS

| | | | |
|---|---|---|---|
| 3,347,584 | 10/1967 | Johnstone | 292/216 X |
| 3,692,343 | 9/1972 | Meyer | 292/216 |
| 3,843,175 | 10/1974 | Klebba | 292/216 |
| 3,905,627 | 9/1975 | Fujita | 292/216 |

*Primary Examiner*—Richard E. Moore

*Attorney, Agent, or Firm*—Holman & Stern

[57] ABSTRACT

The lock is of the type comprising a pivotal fork member movable between an unlocking position towards which it is biased resiliently and a locking position. A detent means is carried by an arm of a pivotal first lever which has two arms and is movable between a retaining position and a releasing position relative to a projecting portion of said fork member and biased towards the releasing position by an unlocking force exerted on the fork member. A second lever is mounted to pivot between a first position, towards which it is returned resiliently and in which it locks an end of the second arm of the first lever when the first lever is in its retaining position, and a second position in which it releases said end and towards which it can be shifted. The fork member comprises two successive locking projecting portions and there is provided a cam surface which is cooperative with a projecting portion of the second lever so as to cause the second lever to temporarily move to its second position when the second projecting portion of the fork member approaches the detent means in the course of the locking movement of the fork member.

15 Claims, 4 Drawing Figures

LOCK IN PARTICULAR FOR AN AUTOMOBILE VEHICLE

The present invention relates to locks employed in particular in automobile vehicles for closing for example doors, the hood of the engine or the luggage compartment of these vehicles.

U.S. Pat. No. 3,347,584 discloses a lock or latch comprising a pivotal fork member movable between an unlocking position toward which it is resiliently biased and a locking position, detent means carried by an arm of a pivotal lever having two arms and movable between a retaining position and a releasing position with respect to a projection portion of the fork member and biased toward its releasing position by an unlocking force exerted on the fork member, and a second lever mounted to pivot between a first position toward which it is resiliently biased and in which it blocks the end of the second arm of the first lever when the latter is in its retaining position, and a second position in which it releases said end and towards which position it can be shifted.

This arrangement having two levers permits obtaining a reduced unlocking force. However, in certain applications, in particular for the closure of automobile doors, it is desirable for easons of safety that the lock have two locking positions for example as described in the West German DE-OS No. 2 065 444. Now, the mechanism of the U.S. patent mentioned before does not permit obtaining this result since its second lever can only operate once. Indeed, only the action of the outside control can return this second lever to the unlocking position when the projecting portion of the fork member is hooked by the first lever so that it is not possible to provide the fork member with a second locking projecting portion.

An object of the invention is to provide a lock or latch of the same type but having two locking positions. For this purpose, the invention provides a lock wherein the fork member comprises two successive locking projecting portions and a cam surface is provided which cooperates with a projecting portion of the second lever so as to shift temporarily the second lever to its second position when the second projecting portion of the fork member approaches the detent means in the course of the locking movement of the fork member.

In another aspect of the invention, there is provided a lock of the type comprising a pivotal fork member movable between an unlocking position to which it is resiliently biased, and a locking position, and a detent means carried by a pivotal lever movable between a retaining position and a releasing position with respect to a projecting portion of the fork member, this lever being part of a detent device, wherein the fork has a cam surface which, when the fork member is biased to the opening position after its projecting portion has passed the detent means during the closure of the lock cooperates with a bearing surface of the pivotal lever so as to positively bring the pivotal lever to its retaining position. This ensures the hooking of the fork member irrespective of the speed at which the door or the like is closed and consequently excludes any risk of a rebound due to the resiliency of the sealing elements.

Further features and advantages of the invention will be apparent from the ensuing description which is given solely by way of a non-limitative example with reference to the accompanying drawings in which.

Figure 1:
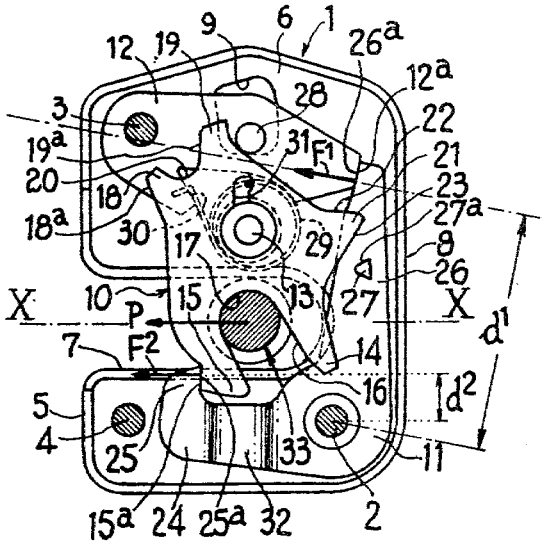
FIG. 1 is an elevational view of a lock according to the invention in the locked position.

The lock shown in FIG. 1 in the locked position is contained in a case or support 1 of a generally parallel-sided shape closed by a planar roughly rectangular plate. The latter, which is maintained by three rivets or the like, 2, 3, 4, located in three of its corners, has not been shown for reasons of clarity. In order to render the description more convenient, it will be assumed that the case is vertical and oriented as shown.

Formed in the large left lateral side 5 and in the lower half of at least the rear side 6 of the case 1 is a horizontal elongated notch 7 which extends nearly to the opposite large lateral side 8 and terminates in a semi-circular shape. The side 6 has moreover an aperture 9 in the shape of an arc of a circle centered on the single rivet 3 located above the notch 7.

The mechanism of the lock comprises a fork member 10 and a detent device formed by a cranked lever 11 and a straight lever 12.

The fork member 10 has the general shape of an H and is pivotable about a pin 13 which extends therethrough in the centre region thereof. The pin 13 is disposed between the aperture 9 and the notch 7 not far from the closed end of the latter.

On one side of the pin 13, the fork member has two branches 14, 15 which define therebetween a recess 16 having a constant width and terminating in a semi-circular shape 17. On the other side, there are two projecting portions 18, 19, which are separated by a hollow 20, the inner end of which is near to the pin 13 and the lower edge of the aperture 9. The left side, $18^a$, $19^a$ of each projecting portion 18, 19, defines a ramp or cam the function of which will be apparent hereinafter, whereas their right side is roughly radial relative to the pin 13. The outer side $15^a$ of the branch 15 is also roughly radial relative to this pin 13.

The left side of the fork member 10, which interconnects the cam $18^a$ and the surface $15^a$, is roughly rectilinear. On the other hand, its right side which interconnects the projecting portion 19 and the branch 14 has in its median part a point 21 which defines an upper cam surface 22 and a lower cam surface 23.

The lever 11 has the shape of an L and freely pivots about the corner of the L shape through which extends the rivet 2 which is diagonally opposed to the rivet 3. Its shorter branch 24 extends toward the left substantially to the neighbouring rivet 4 and terminates in a hook or detent 25 which extends upwardly. Its longer branch 26 extends roughly vertically to beyond the pin 13 and is generally rectilinear. A boss or stud 27 projects from the branch 26 roughly at the level of the upper edge of the notch 7 of the case 1.

The lever 12 is on the whole rectilinear and mounted to pivot about the rivet 3 at its left end. A lug 28 extends through the lever in its median zone this lug extending outside the case 1 through the aperture 9.

A spiral spring 29 wound around the pin 13 bears against a lower hook portion 30 on the lever 12 and in an aperture 31 of the fork member 10 and thus permanently biases the lever 12 downwardly and the branches 14, 15 toward the left.

The lever 12 is in the same plane as the branch 26 of the lever 11. On the other hand, the fork member 10 is in a different plane and the branch 24 of the lever 11 comprises a ramp 32 which is inclined forwardly, which brings the hook portion 25 in the plane of this fork member. The stud 27 projects into this plane.

Figure 4:
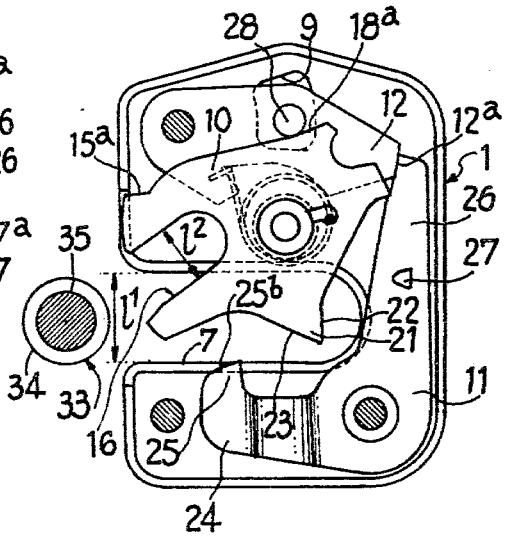
FIG. 4 is a similar view of the unlocked lock.

In order to describe the operation of this lock, it will be assumed that it is mounted on the body of a vehicle, for example on the post of the door. The door is provided with a keeper 33 which, upon closure, enters the notch 7 along the axis X—X of the latter. The base 34 of the keeper 33 is cylindrical and has a diameter equal to, or slightly less than, the width $l^1$ of the notch. The top 35 is also cylindrical but has a reduced diameter equal to the width $l^2$ of the aperture 16 of the fork member (see FIG. 4).

In the illustrated locked position, the keeper 33 is located at the end 17 of the aperture 16; it is located in the vicinity of the end of the notch 7, without however touching the latter, and roughly in vertical alignment with the pin 13 and the lug 28. The hooking face 25$^a$ of the hook portion 25 and the surface 15$^a$ of the branch 15 of the fork member are roughly vertical and are in contact. The same is true of the end 12$^a$ of the lever 12 and the end 26$^a$ of the arm 26. The lever 12 is in the lower position with its lug 28 bearing against the lower edge of the aperture 9. The projecting portion 19 and the point 21 of the fork member are located respectively on the left side of the lug 28 and above the stud 27.

The compression of the sealing elements of the door, and possibly an accidental overload, exert on the keeper a force P in the left direction along the axis X—X. This force creates on the hook portion 25 a force which is smaller $F^2$ and roughly horizontal, the line of action of which passes between the axis X—X and the rivet 2 at a distance $d^2$ above the latter. The lever 11 transfers to the lever 12 the force $F^1$ located above P at a distance $d^1$ from the rivet 2 which is much greater than $d^2$. The force $F^1=F^2(d^2/d^1)$ is therefore very small. The surface 12$^a$ of the lever 12 has such shape than the force $F^1$ is directed roughly toward the axis of the rivet 3 but passes slightly below the latter. The force $F^1$ is thus slightly inclined to the horizontal. It will be observed that $F^1$ creates on the lever 12 a locking torque, that is to say causes this lever to descend, whereas $F^2$ creates on the lever 21 an unlocking torque, that is to say tends to withdraw the hook portion 25. The lengths of contact 25$^a$–15$^a$ and 12$^a$–26$^a$ are minimum bearing in mind the requirements of construction. In practice they may be on the order of a few millimeters, for example 4 millimeters.

In order to unlock the lock, the extension of the lug 28 outside the case 1 is raised by any suitable means (not shown). The energy required for this raising is very small which allows, apart from a considerable smoothness of operation and reduced wear, the possibility of assisting the raising mechanism by an electric motor or other relatively low power-supply.

Figure 2:
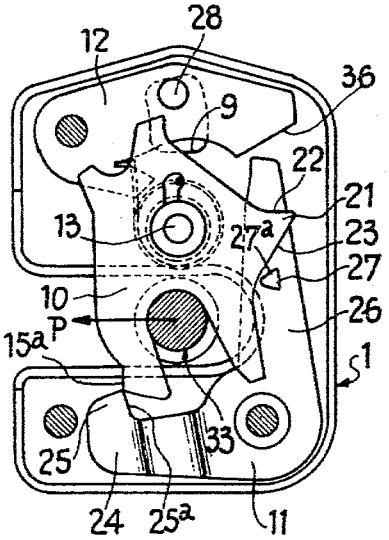
FIGS. 2 and 3 are similar views illustrating two stages of the unlocking of this lock.
Figure 3:
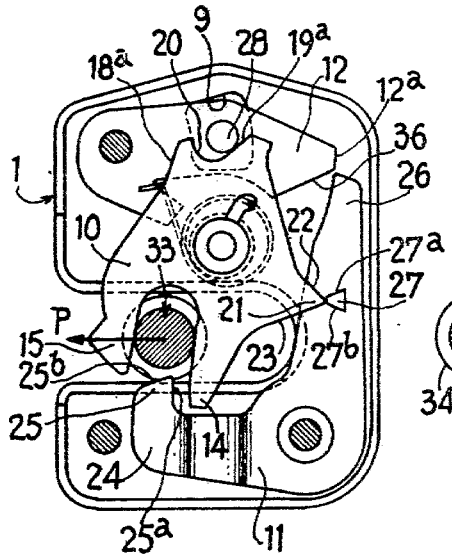

As soon as the lug 28 and therefore the lever 12 is raised, the lever 11 is released; as the force $F^2$ biases the lever to the unlocking position, the latter rotates in the counter-clockwise direction and releases the branch 15. As the lug 28 does not create an obstacle to the projection portions 18 and 19, the fork member 10 starts to rotate in the clockwise direction, under the combined actions of the force P and the spring 29. The start of these unlocking movements is illustrated in FIG. 2. As soon as the branch 15 has travelled beyond the hook portion 25, the ramp 23 of the fork member engages the upper side 27$^a$ of the stud 27, which urges the arm 26 rearwardly and positively constrains the lever 11 to rotate in the clockwise direction and resume its hooking position where the hook portion 25 is in the path of the branch 14 of the fork member. If the lever 12 was then released sufficiently soon, its lug 28 would fall back into the hollow 20 of the fork member and consequently block the lever 11, as shown in FIG. 1 and the lock would remain locked in the safety position or "first locking position".

This situation can occur in the case of an accidental action on the shifting means of the lever 12. On the other hand, when this shifting means is acted upon purposely, the lever 12 does not have time enough to fall back into the hollow 20. While it is still raised, the branch 14 engages the hook portion 25 in the same way as the branch 15 in the preceding stage. As the point 21 has then travelled beyond the stud 27, the lever 11 once again rotates in the counter-clockwise direction; the hook 25 allows the branch 14 to pass and the fork member rotates until it abuts by its surface 15$^a$ against the upper edge of the notch 7, which places the end of the branch 14 in the vicinity of the entrance of this notch slightly below the axis X—X of the latter.

Then the lug 28, which is released by the shifting mechanism, again descends under the action of the spring 29. In the course of this movement, a lower oblique ramp or surface 36 provided in the end part of the lever 12 encounters the end of the arm 26 and tends to turn the latter towards the right by creating a torque in the clockwise direction on the lever 11. Thereafter, the hook portion 25 rises again behind the branch 14 as soon as the latter has passed it. The lug 28 bears on the base of the ramp 18$^a$ and the end of the arm 26 of the lever 11 is in contact with that of the lever 12 with a possible small angular clearance for the arm 26 between this lever 12 and the lateral wall of the case 1. The opening of the lock is then terminated.

It will be observed that in the assumption of the very brief accidental action on the lever 12 mentioned above, when this lever falls back after releasing the branch 15 of the fork member, the cam 36 on principle engages the end of the arm 26 in the manner just described and contributes to the return of the lever 11 to the hooking position. However, in practice, the inertia of the lever 12 has for result that it is the action of the cam 23 on the stud 27 which is essential.

The closing of this lock will now be described.

When the keeper 27 engages the notch 7 (FIG. 4), its top 35 engages the branch 14 of the fork member and causes the start of the locking movement of the latter which is a rotation in the counter-clockwise direction in opposition to the action of the spring 29. Right from the start of this movement, the ramp 18$^a$ raises the lug 28 and completely disengages the lever 12 from the end of the arm 26 also in opposition to the spring 29 slightly before the end of the branch 14 comes in contact with the inclined engaging surface 25$^b$ of the hook portion 22.

As the lever 11 is free it can pivot in the counter-clockwise direction and allow the branch 14 to pass the hook portion 25. As soon as the branch 14 has passed this hook portion 25, the upper cam 22 of the point 21 engages the lower side 27$^b$ of the stud 27 and positively obliges the lever 11 to rotate in the clockwise direction so as to bring the hook portion 25 to the locking position. At this moment, the lug 28 passes by the top of the projection portion 18 and falls back toward the lower edge of the aperture 9 under the action of the spring 29. Note that this movement is unhindered by the lever 11 and can therefore be carried out very rapidly, the cam 36 not intervening. Thenceforth, if the keeper 33 ceases its movement, the lug 28 bears on the lower edge of the aperture 9 which is rendered possible by the hollow 20 of the fork member. The lock is then in a first locking position or "first step locking position".

However, normally, the keeper 33 continues to progress toward the right; a large part of the sequence of movements described above is then repeated the branch 15 and the projecting portion 19 with its ramp 19$^a$ replacing respectively the branch 14 and the projecting portion 18 with its ramp 18$^a$. Thus, the ramp 19$^a$ raises a second time the lug 28 then the branch 15 urges back the hook portion 25, the lug 28 passes by the projecting portion 19 and the lever 12 falls back. On the other hand, when this lever 12 falls back, it is this lever which returns the lever 11, under the action of its cam 36 on the arm 26, to the locking position. Consequently, as soon as the branch 15 pass by the hook portion 25 under the action of the cam 36, the hook portion rises again and the two levers 11, 12 are in their initial positions of FIG. 1. The lock is then in its normal locking position or "second stage locking position". It is of course for reasons of safety that two locking stages are provided.

If the door is closed violently, when the branch 15 has passed by the hook portion 25, the compression of the sealing elements may produce by a rebound action a reverse rotation (in the clockwise direction) of the fork member before the lever 11 has time to return to the position for hooking this branch 15 under the action of the cam 36, owing to the inertia of the two levers. In this case, as soon as the branch 15 has passed by the hook portion 25 toward the left, the cooperation of the cam 23 and the stud 27 positively returns the lever 11 to the position for hooking the branch 14, as described above. The lever 12 is then free to redescend very rapidly into the hollow 20 so as to lock the lever 11 in this position. The lock is thus locked in a sure manner in the safety stage.

Tests carried out have shown that such a lock operates in a very satisfacory manner. However, it will be understood that it is possible, in a modification (not shown), to provide an additional cam-stud couple such as 22–27 which, upon closure, positively brings the lever 11 to the position for hooking the second branch 15 as soon as the latter has passed through the hook portion 25. In this case, the cam 36 now performs a very secondary function, since all the movements of the lever 11, in the clockwise direction, are controlled in a positive and direct manner by the very movements of the fork member, which clears the downward path of the lever 12. The additional cam may for example by carried by the branch 14 under the point 21 and be cooperative with a second stud projecting from the lever 11; this second stud may be resiliently yieldable so as to take into account the possible different degrees of penetration of the keeper 33 in the notch 7.

Note that, owing to the gearing-down arrangement of the two levers, it is possible to construct the lever 12 in a light construction having low inertia which enables it to fall back extremely rapidly into the position for locking the lever 11 each time the latter is brought to the blocking position by a cam-stud action described above.

By way of a modification, a spring (not shown) could urge the lever 11 to its initial position. Also by way of a modification, the base of the ramp 18$^a$ could have a low point relative to the pin 13, in which case the fork member 10 would itself find its equilibrium in the position of FIG. 4 without abutting necessarily by its surface 15$^a$ against the wall of the case 1.

It must be understood that the case 1 could be movable and the keeper 33 fixed and the lock could serve to close other elements, for example a luggage compartment or an automobile engine hood or bonnet.

Having now described our invention what we claim as new and desire to secure by Letters Patent is:

1. A lock, in particular for an opening element of an automobile, comprising a pivotal fork member which has a projecting portion and is movable between an unlocking position and a locking position, means combined with the fork member for resiliently biasing the fork member to the unlocking position thereof, detent means carried by an arm of a pivotal first lever having a first arm and a second arm and movable between a retaining position and a releasing position relative to said projecting portion of the fork member and means for biasing the pivotal lever towards its releasing position by an effect of an unlocking force exerted on the fork member, and a second lever mounted to pivot between a first position and a second position, means for resiliently biasing the second lever towards its first position, the second lever being capable of blocking an end of the second arm of the first lever in the first position of the second lever when the first lever is in the retaining position of the first lever, and the second lever being capable of releasing said end of the second arm in the second position of the second lever, means operatively connected to the second lever for shifting the second lever to the second position of the second lever, the fork member comprising two successive projecting portions, the fork member carrying means defining a cam surface, the second lever having a projecting portion with which projecting portion the cam surface is cooperative so as to cause the second lever to move temporarily to the second position of the second lever when the second projecting portion of the fork member approaches the detent means in the course of a locking movement of the fork member.

2. A lock as claimed in claim 1, wherein the second lever comprises a ramp engageable with the end of the second arm so as to bias the first lever to the retaining position of the first lever and means defining a second cam surface cooperative with said projecting portion of the second lever so as to cause the second lever to move temporarily to the second position of the second lever when the first projecting portion of the fork approaches the detent means in the course of the locking movement of the fork member.

3. A lock as claimed in claim 1, or 2, wherein the first lever is freely rotatable.

4. A lock as claimed in any one of the claims 1 to 3, wherein the first lever is adapted in such manner as to gear down the force that it transmits to the second lever relative to that to which the detent means is subjected.

5. A lock as claimed in claim 1, wherein each projecting portion of the fork member is constituted by a branch of the fork member.

6. A lock as claimed in any one of the claims 1 to 2, wherein the second lever is engaged substantially radially by the second arm in the locking position of the lock.

7. A lock as claimed in claim 6, wherein the force exerted by the second arm on the second lever passes to one side of the axis of pivoting of the second lever so as to tend to bias the second lever to the first position of the second lever.

8. A lock as claimed in any one of the claims 1 to 3, wherein the first lever has an L-shape, the end of the first arm forming a hook portion which faces inwardly of the L-shape and constitutes the detent means.

9. A lock in particular for an opening element of an automobile, comprising a pivotal fork member having a projecting portion and movable between an unlocking position and a locking position, means for resiliently biasing the fork member towards the unlocking position, a pivotal lever comprising a bearing surface and movable between a retaining position and a releasing position relative to the projecting portion of the fork member, a detent member carried by the pivotal lever, said lever being part of a detent means, the fork member having a cam surface which, when the fork member begins a return movement towards the unlocking position after its projecting portion has passed the detent member during the closure of the lock, is cooperable with the bearing surface of the pivotal lever so as to positively bring the pivotal lever to the retaining position of the pivotal lever.

10. A lock as claimed in claim 9, wherein the pivotal lever has a second bearing surface and the fork member has a second cam surface which cooperates with the second bearing surface of the pivotal lever during the closure of the lock so as to positively bring the pivotal lever to the retaining position thereof as soon as the projecting portion of the fork member has passed the detent means.

11. A lock as claimed in claim 10, wherein the first and second bearing surfaces are defined by a single same boss which projects from the pivotal lever.

12. A lock as claimed in claim 1 or 9, in which the fork member comprises two successive projecting portions and each cam surface and the bearing surface associated therewith are adapted to bring the detent means between the two projecting portions.

13. A lock as claimed in claim 1, wherein the pivotal lever has a third bearing surface and the fork member comprises a second projecting portion furnishing a second hooking step onto the detent means and a third cam surface which is cooperative with the third bearing surface of the pivotal lever during the closure for positively bringing the pivotal lever to the retaining position of the pivotal lever as soon as the second projecting portion of the fork member has passed the detent means.

14. A lock as claimed in claim 13, wherein the third bearing surface is elastically yieldable.

15. A lock as claimed in any one of the claims 1 to 2 and 9, comprising a second lever which is shiftable, a spring for biasing the second lever to a locking position of the second lever, the pivotal lever being a lever having two arms, one of which arms carries the detent means and the other arm may be selectively released and blocked by the second lever.

* * * * *